US008955474B1

(12) United States Patent
Derbin et al.

(10) Patent No.: US 8,955,474 B1
(45) Date of Patent: Feb. 17, 2015

(54) CLOSED LOOP ELECTRONIC CONTROL FOR THE REDUCTION OF SOOT PRODUCED IN DIESEL, GASOLINE AND ALTERNATIVE-FUELED ENGINES

(76) Inventors: Patrick J. Derbin, Milford, MI (US); Michael J. Holihan, Saugus, CA (US)

( * ) Notice: Subject to any disclaimer, the term of this patent is extended or adjusted under 35 U.S.C. 154(b) by 334 days.

(21) Appl. No.: 13/439,760

(22) Filed: Apr. 4, 2012

Related U.S. Application Data

(60) Provisional application No. 61/475,630, filed on Apr. 14, 2011.

(51) Int. Cl.
*F01P 1/04* (2006.01)

(52) U.S. Cl.
USPC ..... 123/41.35; 123/41.31

(58) Field of Classification Search
USPC ..... 123/41.31, 41.35
See application file for complete search history.

(56) References Cited

U.S. PATENT DOCUMENTS

| | | | | |
|---|---|---|---|---|
| 2,788,773 | A * | 4/1957 | Meurer | 123/41.35 |
| 2,800,119 | A | 7/1957 | Schmidl | |
| 3,065,743 | A * | 11/1962 | Brehm et al. | 123/41.35 |
| 4,667,630 | A * | 5/1987 | Sasaki | 123/41.35 |
| 5,819,692 | A | 10/1998 | Schafer | |
| 6,955,142 | B2 | 10/2005 | Patel et al. | |
| 7,360,510 | B2 * | 4/2008 | Bontaz et al. | 123/41.35 |
| 2005/0120982 | A1 | 6/2005 | Ducu | |
| 2007/0022981 | A1 * | 2/2007 | Ernst et al. | 123/41.35 |
| 2008/0308353 | A1 * | 12/2008 | Aixala | 184/6.5 |

FOREIGN PATENT DOCUMENTS

JP 01077719 A * 3/1989

* cited by examiner

*Primary Examiner* — Noah Kamen
(74) *Attorney, Agent, or Firm* — Knobbe Martens Olson & Bear LLP

(57) ABSTRACT

A system and method of reducing soot and/or improving the efficiency of a motor. The system and method regulates the supply of cooling oil to a cooling section of a cylinder based upon observed parameters. These parameters can include such things as engine temperature, load, rpm etc. The control can be provided by using a look up table.

17 Claims, 3 Drawing Sheets

CLOSED LOOP ELECTRONIC CONTROL FOR THE REDUCTION OF SOOT PRODUCED IN DIESEL, GASOLINE AND ALTERNATIVE-FUELED ENGINES

CROSS-REFERENCE TO RELATED APPLICATIONS

This application claims the benefit of U.S. Provisional Application No. 61/475,630 filed Apr. 14, 2011, which is incorporated by reference herein in its entirety.

BACKGROUND OF THE INVENTION

1. Field of Invention

The present invention pertaining to diesel, gasoline, alternative-fuel internal combustion engines, is comprised of a closed loop electronic control system, to deliver a more precise amount of oil through a solenoid valve and cooling nozzle to a piston underside, and in particular, shall improve or even optimize the piston dome temperature for the reduction of soot production and particulate matter both in the oil and out the exhaust, allowing for increased engine efficiency at all operating conditions.

2. Description of the Related Art

A typical internal combustion engine includes an engine block with a reciprocating piston within a cylinder bore. The piston assembly travels a fixed distance in a cylinder bore and is connected to a connecting rod which in turn is attached to a rotating crankshaft. The piston is generally comprised of both a dome and a skirt (some cases, not all) and will require oil cooling to the underside of the piston dome for cooling and lubrication purposes. Typical piston cooling on a heavy duty diesel engine is generally accomplished by delivering pressurized oil from the crankcase oil system in the form of a spray or stream through a piston oil nozzle assembly, which is connected to an oil passage generally located inside the lower crankcase area. Moreover, the piston oil nozzle assembly is generally mounted directly in the lower internal crankcase area, adjacent each piston cylinder location.

Present technology for cooling the piston throughout the entire engine operating range, is to supply crankcase oil for cooling through the piston oil nozzle assembly explicitly to satisfy the worst case engine operating condition. Unnecessary high pumping power is required to circulate the engine oil used for cooling. The oil flow is constant for any given engine rpm and not load dependent. Moreover, if the engine is not operated at 100% load condition, resultant excessive cooling to the piston dome underside will result in overcooling the piston dome which contributes to elevated soot levels in the crankcase oil and reduced engine efficiency. To help address this issue, alternative piston cooling management systems have been developed.

For example U.S. Pat. No. 2,800,119 to Schmidl discloses an arrangement for cooling the piston of an internal combustion engine, more particularly, to control the share of lubricating oil branched off to the piston and piston head, in dependence upon engine speed. The improvement comprises a spray nozzle in said piston cooling branch circuit having an opening of a size to permit a flow resistance to the passage of oil less than the flow resistance in the lubricating branch circuit at engine idling speeds. Furthermore, a check valve exits connecting this said nozzle with a means for opening said valve under the pressure of the main oiling circuit during normal engine running speeds, but closing this said valve during low running or engine idling speeds.

While the Schmidl reference discloses a mechanism for cooling the piston throughout a range of engine operating conditions, Schmidl's enhanced spray nozzle introduces a non-return valve and compression spring assembly that will be prone to hysteresis and sticking effects. Furthermore, variations in the oil pumping circuit cannot be compensated by the open loop design of the enhanced spray nozzle, providing a non-optimized solution as thousands of hours of wear are imposed on the cooling system components. In addition, the Schmidl design is regulated by an oil pressure relief valve located in the piston oil nozzle assembly, allowing oil to the piston nozzle until the engine crankcase oil pressure exceeds the predetermined nozzle relief valve setting. At this threshold point, the piston oil spray nozzle starts flowing crankcase oil through the nozzle orifice assembly. The actual oil to the piston cooling nozzle now becomes crudely controlled by the engine rpm, determining the crankcase oil pressure. This simplistic control strategy is typically found in today's modern engines and has a minimal at best opportunity to regulate the desired oil flow to the piston for cooling.

U.S. Pat. No. 5,819,692 issued to Schafer, discloses a control mechanism for spraying lubrication oil to the piston, whereby the temperature of the piston is controlled within a preferable range to prevent overheating under high load conditions, or overcooling at low load conditions. A direct-acting thermostatic valve is positioned into a machined passage in the engine for diverting lubricant from the main oil gallery passage into individual branch passages leading to each spray nozzle.

While the U.S. Pat. No. 5,819,692 reference discloses a method to provide cooling of the piston for a range of engine conditions, the control mechanism relies on a tubular valve element that is reciprocated back and forth in the main oil passage by a thermostatic power element located in the main passage. This valve and thermostatic power element would be difficult to control due to potential sticking and hysteresis effects and would result in a sluggish response rate for the piston cooling methodology. Over the wide spectrum of rpm and load conditions imposed on the piston, mandatory precise cooling needs delivered to the pistons at the required time would be absent.

It is desirable to introduce an electronically controlled solenoid valve actuated by an engine power control module, to regulate oil flow for the purpose of piston cooling. To address this need, U.S. Pat. No. 6,955,142 B2 to Patel discloses the use of an electronic solenoid valve within an oil supply manifold to activate and deactivate an oil squirter system. For low engine rpm, the said solenoid valve would close to restrict oil flow and deactivate the oil squirter. As engine rpm increases, the solenoid valve would open and allow the oil to spray on the pistons and cylinders for lubrication and cooling purposes.

Although the electronically controlled solenoid valve in the Patel patent provides the mechanism for delivering oil for piston cooling, there exists no provision for precisely delivering oil spray based on a plurality of engine load conditions for the purpose of reducing soot production and improving engine efficiency.

Hence, it will be appreciated that there is a continuing need for a robust control methodology to manage the temperature of a piston dome based on rpm and load, by more precisely regulating the flow of crankcase oil.

SUMMARY OF THE INVENTION

The aforementioned needs are satisfied by the piston dome cooling device of the present invention which, in one aspect, is comprised of a pulse-width-modulated (pwm) solenoid valve or other electrically controlled solenoid valve, wherein lubrication oil from the oil sump is pumped by the oil pump through this control valve and routed to a plurality of oil spray nozzles in a parallel circuit configuration. In one implementation, one spray nozzle is utilized per cylinder and is preferably attached at the lower internal crankcase area, adjacent the bottom of each piston cylinder bore opening. Improved optimal piston cooling is achieved by routing oil through the pwm solenoid valve based on the pulse width of the feed forward command, dictated by the on-board electronic control module (ecm). It will be appreciated that this electronic closed loop methodology for piston cooling is based proportionally to the imposed thermal loading on the piston dome, rather than piston cooling delivered based on a worst case engine operating condition scenario.

The amount of crankcase oil delivered to the piston spray nozzle shall be a function of engine feedback parameters, rpm, torque, fuel consumption (calculated), air temperature, oil temperature, water temperature, turbo boost pressure and all necessary parameters required for optimal engine feedback control. The desired set point signal from the ecm to the pwm valve or other controllable valve shall be dictated based on these feedback parameters and a "table lookup" performed for obtaining the desired duration of the pulse width. Specifically, in one implementation, the longer the pulse width duration, the longer oil will spray to the piston. It is advantageous to tailor the pulse width duration (commonly referred to as duty cycle) based on the engine operating conditions, i.e., light load conditions shall dictate a short duration pulse width, whereas a heavy load condition (vehicle pulling a heavy load up an elevated grade) will translate into a high duration pulse width from the ecm. The pwm valve is an electronically controlled solenoid valve and is powered from the vehicle's 12 vdc power source (higher d.c. voltage sources may be required based on application), whereas the ecm is electronically interfaced to this pwm valve. The location of the pwm valve is preferably located close to the spray nozzle so as not to encourage pressure drops and/or sluggish system response in the cooling circuit. In the present embodiment, the cooling oil output port of the pwm solenoid valve is attached in a parallel fashion to a "common rail" cooling circuit to the total number of cooling nozzles, i.e., the total number of pistons in the engine block configuration (not limited to a specific number of cylinders).

In another embodiment, it will be appreciated that a plurality of pwm valves or similar controlled valves may be employed and each valve shall be devoted to the control of cooling on a per piston basis. In particular, the ecm shall individually manage the cooling needs of each said piston by incorporating distinct table look entries per cylinder, providing for the ultimate optimization of piston dome cooling. These additional controlled valves will provide for adequate flow characteristics to cover the oil cooling requirements of the pistons and specifically the wide-open-throttle (wot) condition. WOT is the 100% load condition and generally the worst case engine operating case scenario. It will be noted that other embodiments of the present invention may be employed; whereas a single pwm valve may be shared with multiple cylinders to provide adequate cooling for all cylinders in the engine block.

Another aspect of the invention comprises a system for cooling a piston of an internal combustion engine having at least one cylinder that receives the piston wherein the cylinder defines a combustion region and a cooling region, wherein the internal combustion engine includes an oil supply system that supplies oil to the cooling region of the cylinder, the system comprising one or more sensors that sense performance parameters of the internal combustion engine, an oil gating system that is controllable so that the amount of oil provided to the cooling region is adjustable, and a controller that receives signals from the one or more sensors and provides control signals to the oil gating system wherein the controller determines the amount of oil to provide to the cooling region based upon the one or more sensors so that the oil provided to the cooling region of the cylinder is reduced to inhibit excess soot production.

Another aspect of the invention comprises a method of controlling the production of soot by an internal combustion engine, the method comprising monitoring performance parameters of the internal combustion engine, determining the amount of oil to be delivered to a cooling region of at least one cylinder of the internal combustion engine based upon the monitored performance parameters so that the amount of soot produced by the internal combustion engine is reduced and controlling an oil gating system to control the amount of oil being delivered to the cooling region of the at least one cylinder based upon the determined amount.

Another aspect of the invention comprises an internal combustion engine system comprising at least one cylinder that receives at least one piston wherein the cylinder defines a combustion region and a cooling region, an oil supply system that supplies oil to the cooling region of the at least one cylinder, the system comprising, one or more sensors that sense performance parameters of the internal combustion engine, an oil gating system that is controllable so that the amount of oil provided to the cooling region is adjustable, and a controller that receives signals from the one or more sensors and provides control signals to the oil gating system wherein the controller determines the amount of oil to provide to the cooling region based upon the one or more sensors so that the oil provided to the cooling region of the cylinder is reduced to inhibit excess soot production.

Another aspect of the invention comprises a system for cooling a piston of an internal combustion engine having at least one cylinder that receives the piston wherein the cylinder defines a combustion region and a cooling region, wherein the internal combustion engine includes an oil supply system that supplies oil to the cooling region of the cylinder, the system comprising one or more sensors that sense performance parameters of the internal combustion engine, an oil gating system that is controllable so that the amount of oil provided to the cooling region is adjustable, and a controller that receives signals from the one or more sensors and provides control signals to the oil gating system wherein the controller determines the amount of oil to provide to the cooling region based upon the one or more sensors so that the oil provided to the cooling region of the cylinder is reduced to improve the efficiency of the motor.

DETAILED DESCRIPTION OF THE PREFERRED EMBODIMENT

Figure 1:
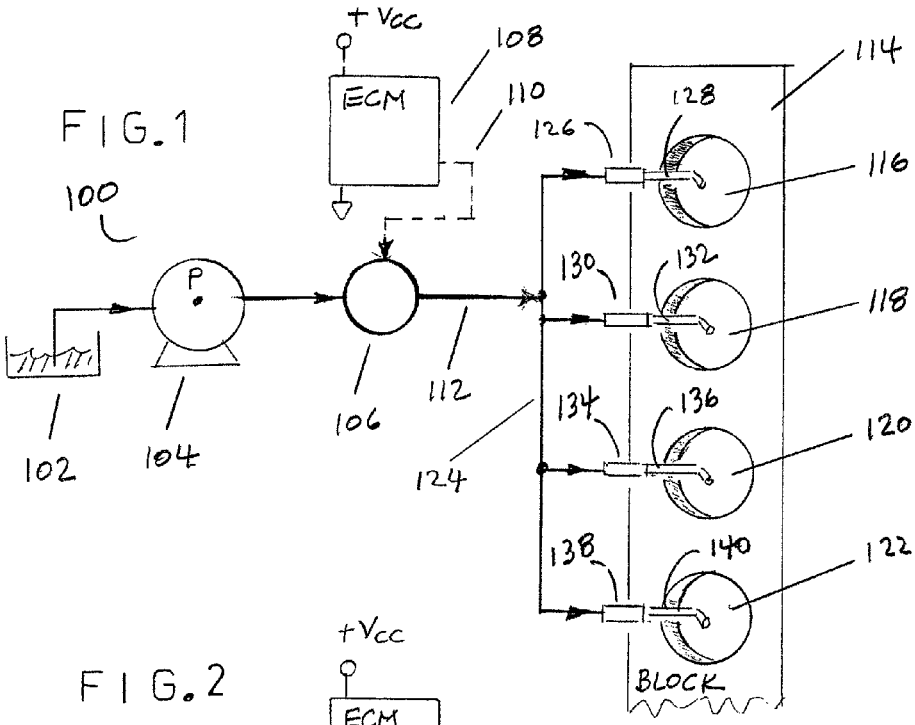
FIG. 1 is a schematic view of one embodiment of a piston cooling arrangement embodying the invention.

Reference will now be made to the drawings wherein like numerals refer to like parts throughout. FIG. 1 illustrates an initial embodiment of a piston cooling lubrication system 100 for a diesel, gasoline, alternative-fuel engine, that comprises an oil lubricating pump 104 which pumps oil from the crankcase 102 through an electronically controlled valve such as a pwm valve 106 through flow passage 112 to a "common rail" oil passage 124 to a plurality of oil spray nozzles 126, 130, 134, 138. Spray nozzle 126 has a protruding tip 128 which is preferably directed to the bottom side of piston dome 116, whereas piston 116 moves up and down in engine block 114. In addition, oil spray tips 132, 136 and 140 are pointed to the bottom side of pistons 118, 120 and 122 respectively. This embodiment 100 represents a four-cylinder engine configuration as illustrated by pistons 116, 118, 120 and 122.

Figure 2:
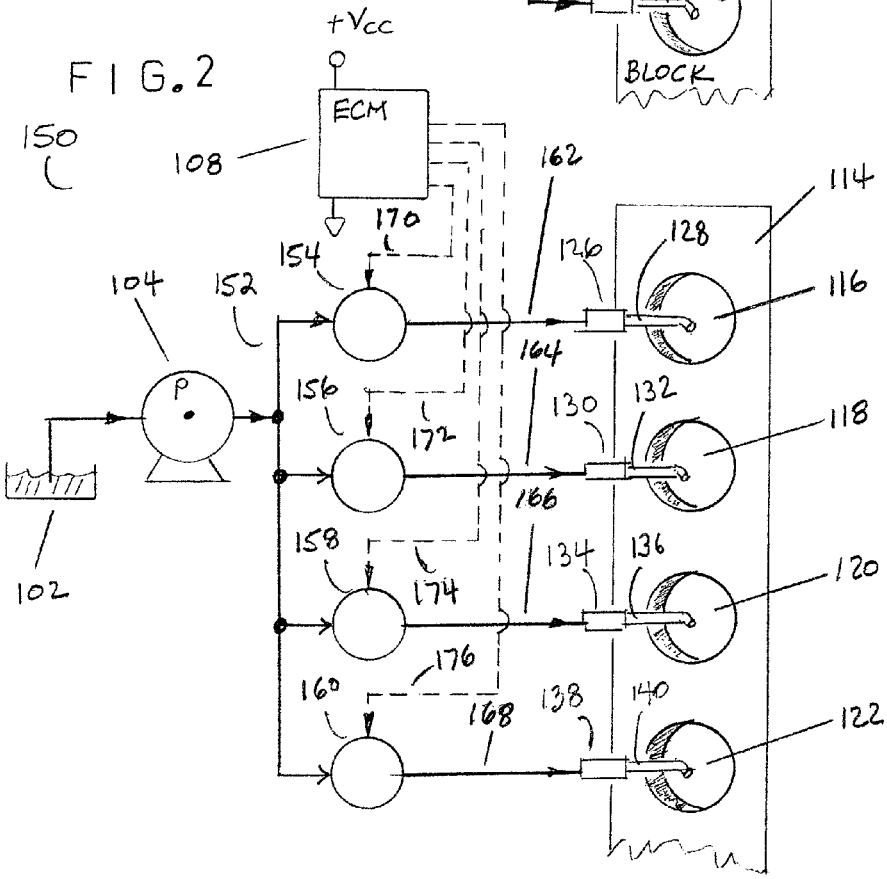
FIG. 2 is a schematic view of another embodiment of the invention.

FIG. 2 illustrates another embodiment 150 of the present invention and, in particular utilizes the same oil pump 104 to draw lubrication oil from the crankcase 102 to a common rail manifold 152. The sump oil 102 will flow in a parallel circuit configuration through electronically controlled valves such as pwm valves 154, 156, 158 and 160. It will be appreciated that pwm valve 154 flows oil directly through spray nozzle 126 and spray tip 128 where the oil is preferably directed to the underside of piston 116. This embodiment 150 provides for a pwm valve to manage piston cooling on a per piston basis. In FIG. 1, ecm 108 is electronically connected through conductor 110 to pwm valve 106, hence the ecm controls only one pwm valve 106 for an entire bank of cylinders 116, 118, 120, 122. Embodiment 150 provides for individual electronic control of each pwm valve 154, 156, 158, and 160 by direct connection to ecm 108 output control ports 170, 172, 174 and 176 respectively. More specifically, the precise oil delivery from pwm valve 154 is fed through oil passage 162 to oil spray nozzle 126 and spray tip 128 to piston underside 116. Continuing further, pwm valve 156 will deliver oil through oil passage 164 through nozzle 130 and spray tip 132 to piston underside 118. PWM valve 158 routes oil directly through oil passage 166 through nozzle 134 and spray tip 136 to piston underside 120. Moreover, pwm valve 160 directly connects oil passage 168 to nozzle 138 and spray tip 140 to cool piston underside 122. In this fashion, piston cooling management may be accomplished by ecm 108 with the employment of table driven look-up entries on a per piston basis.

Figure 3:
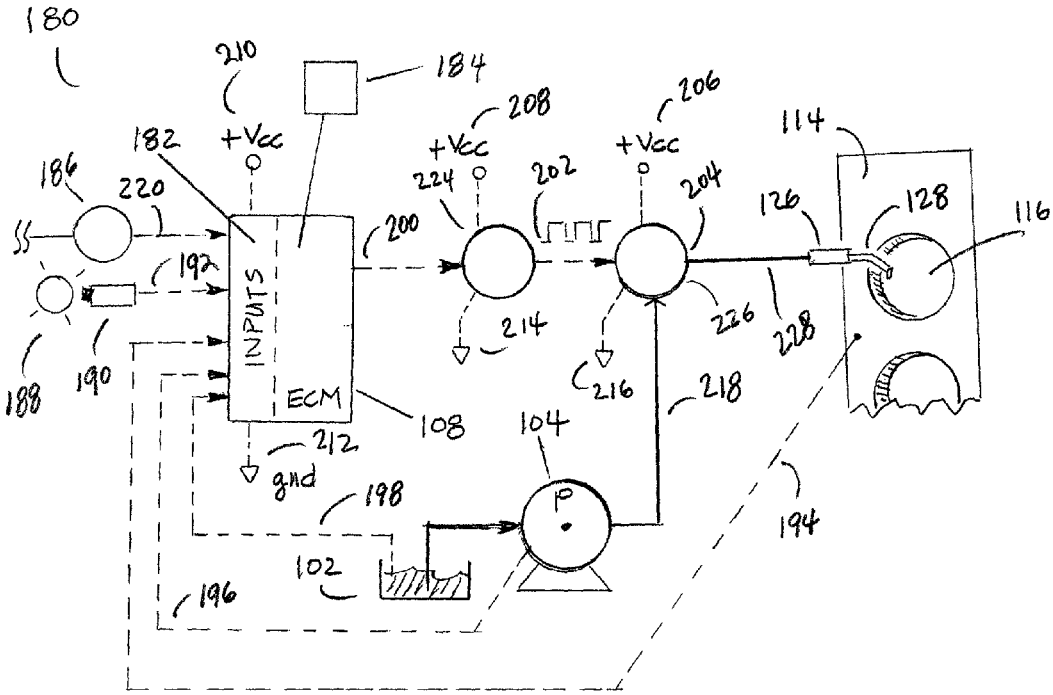
FIG. 3 is a block diagram of the closed loop elements comprising the invention.

FIG. 3 represents a block diagram of the closed loop control components of embodiment 100 from FIG. 1 and embodiment 150 of FIG. 2. Closed loop control elements 180 are commonly used in a typical modern day diesel, gasoline, alternative-fuel engine application that incorporates an ecm 108 to perform the task of fuel management/control of fuel injectors (not illustrated). For the purpose of clarifying the explanation of the control methodology, only a single piston 116 of the engine block 114 is illustrated in a cutaway view of embodiment 100 of FIG. 1 and embodiment 150 of FIG. 2. The ecm 108 has a plurality of dedicated hardware input channels 182 for the purpose of reading engine water temperature 194, oil pump pressure 196, oil temperature 198 and engine speed 192, measured by a multi-tooth gear or wheel 188, spinning past a magnetic pickup 190. Some diesel engine applications employ a turbo boost sensor 186 input 220. The present invention capitalizes on the aforementioned sensor feedback to calculate in real time the cooling requirements of piston 116, based proportionally as a function of the thermal loading imposed on the piston dome of piston 116.

Figure 4A:
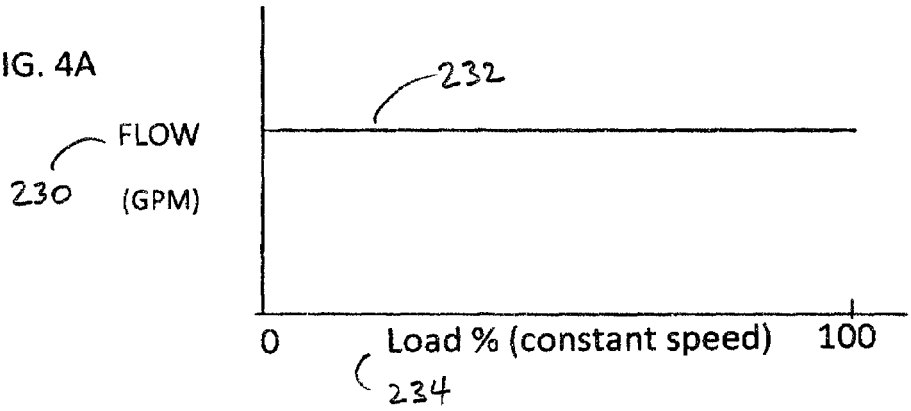
FIG. 4A is a chart depicting cooling flow vs. (load %), at constant speed in a typical diesel, gasoline, alternative-fuel engine application.
Figure 4B:
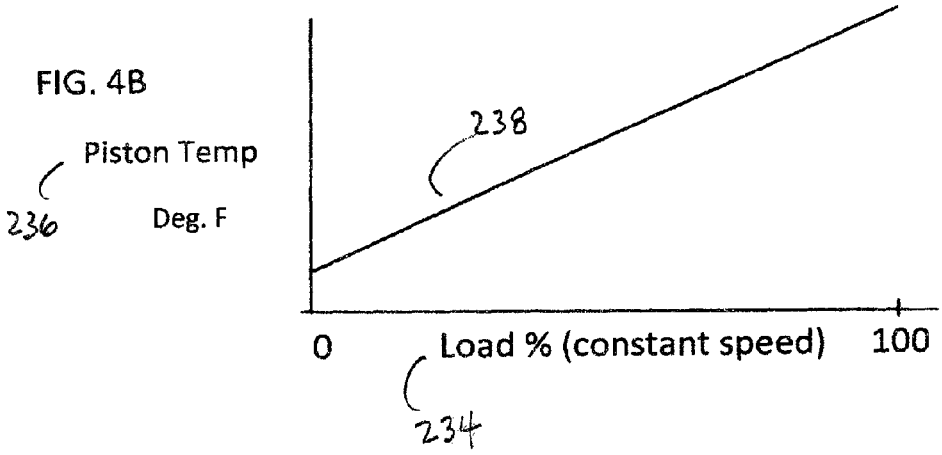
FIG. 4B is a chart depicting piston temperature vs. (load %), at constant speed in a typical diesel, gasoline, alternative-fuel engine application.

In particular, FIG. 4A is an example graph of oil flow 230 in gallons per minute (gpm) versus the Load 234 imposed on the pistons of a typical diesel, gasoline, alternative-fuel engine application. It can be seen that the oil flow 230 is held at a constant level 232 throughout the entire range of Load 234 (0 to 100%) imposed on the engine's piston domes. The oil flow to the piston underside is held constant to accommodate a worst case load scenario, resulting in an over-cooled piston, producing an excessive amount of soot in the oil and a reduction of engine efficiency. In addition, FIG. 4B illustrates that in conventional piston cooling systems, piston temperature 236 increases proportionally 238 based on the imposed Load 234 (at constant engine speed). Referring back to FIG. 3, it will be appreciated that the closed loop control methodology 180 enables a precision amount of oil flow be tailored to the piston for cooling at every engine load scenario, and not based strictly on a worst case 100% full load scenario. For example, a light load condition requiring minimal engine fuel consumption may translate the low turbo boost sensor 186 signal 220, and calculated table look-up 184 values to an output pulse width of 20% to be generated by the ecm 108. In particular, the pwm output signal 200 is fed to a pwm driver circuit 224, providing the necessary current and voltage output drive characteristics 202 to modulate the pwm valve 204. It will be noted that pwm driver circuit 224 is required if the ecm 108 does not have sufficient drive capability to directly interface to pwm valve 226. The 20% pulse width will provide a signal representing approximately 20% of the maximum oil spray through nozzle 126 and spray tip 128 to the piston underside 116, representing optimal cooling capability to the piston for a relatively low piston load. In contrast, a much higher load (more fuel used by the engine), may translate to an 85% pulse width, producing a longer duration pulse width signal from ecm output 200, and driver circuit 224 to pwm valve 226. This 85% pulse width will provide an oil spray flow rate at the upper end capability of the closed loop cooling system 180 for flowing oil to the output 204 of pwm valve 226 through oil channel 228 to oil nozzle 126 and spray tip 128 to piston underside 116. The direct current (D.C.) supply voltage connection(s) 208, 206 required for powering the pwm valve 226 and for the pwm driver 224 may or may not be the same as the ecm voltage source 210 and is based on the voltage requirement of the pwm valve 226 and pwm driver circuit 224. In addition, the D.C. voltage source 210, 208, 206 shall be referenced to circuit ground connections 212, 214 and 216. It will be noted that some vehicle electrical systems, stationary generator sets, and marine applications may not use the customary 12 VDC supply source.

Although the foregoing description of the preferred embodiment of the present invention has shown, described and pointed out the fundamental novel features of the invention, it will be understood that various omissions, substitutions and changes on the form of the detail of the apparatus as illustrated as well as the uses thereof, may be made by those skilled in the art without departing from the spirit of the present invention. Consequently, the scope of the present invention should not be limited to the foregoing discussion, but should be defined by the appended claims.

What is claimed is:

1. A system for cooling a piston of an internal combustion diesel engine having at least one cylinder that receives the piston wherein the cylinder defines a combustion region and a cooling region, wherein the internal combustion engine includes an oil supply system that supplies oil to the cooling region of the cylinder, the system comprising:

one or more sensors that sense performance parameters of the diesel internal combustion engine;

an oil gating system that is controllable so that the amount of oil provided to the cooling region is adjustable;

a controller that receives signals from the one or more sensors and provides control signals to the oil gating system wherein the controller determines the amount of oil to provide to the cooling region based upon the one or more sensors via a look up table that has values selected to inhibit soot production over the operating range of the diesel engine by decreasing the amount of oil provided to the diesel engine so that the oil provided to the cooling region of the cylinder is reduced to inhibit excess soot production in both airborne exhaust and in the oil wherein the values are used to control the operation of the oil gating system such that oil is gated based upon the look up values.

2. The system of claim 1, wherein the controller determines the amount of oil to provide to the cooling region based upon one or more sensors so that the oil provided to the cooling region of the cylinder is reduced during periods of low load on the engine.

3. The system of claim 1, wherein the one or more sensors include RPM sensors, temperature sensors and fuel sensors.

4. The system of claim 1, wherein the oil gating system comprises at least one controllable valve that allows a metered amount of oil to flow from the oil supply system to the cooling region of the cylinder.

5. The system of claim 4, wherein the controllable valve is a pulse width modulated (PWM) valve that receive pulse signals from the controller to regulate the amount of oil that is provided to the cooling region of the cylinder.

6. The system of claim 4, wherein the at least one cylinder comprises a plurality of cylinders and the at least one controllable valve comprises a single valve positioned in a common rail of the oil supply system that meters the amount of oil provided to the plurality of cylinders.

7. The system of claim 4, wherein the at least one cylinder comprises a plurality of cylinders and the at least one controllable valve comprises a plurality of controllable valves respectfully associated with one of the plurality of cylinders.

8. The system of claim 1, wherein the controller includes a look up table that provides oil flow parameters based upon sensed signals from the one or more sensors.

9. A method of controlling the production of soot by an internal combustion diesel engine, the method comprising:

monitoring performance parameters of the diesel internal combustion engine;

determining the amount of oil to be delivered to a cooling region of at least one cylinder of the internal combustion engine based upon the monitored performance parameters and based upon a plurality of values in a look up table that are selected to inhibit soot production over the operating range of the engine in both airborne exhaust and in the oil by decreasing the amount of oil provided to the diesel engine so that the amount of soot produced by the internal combustion engine is reduced;

controlling an oil gating system to control the amount of oil being delivered to the cooling region of the at least one cylinder based upon the determined amount and the values of the look up table.

10. The method of claim 9, wherein determining the amount of oil to be delivered to the cooling region comprises determining the amount of oil to be delivered to the cooling region to be a reduced amount during periods of low load for the internal combustion engine.

11. The method of claim 9, wherein monitoring the performance parameters of the internal combustion engine comprises monitoring the RPM, the temperature and the fuel consumption of the internal combustion engine.

12. The method of claim 9, wherein controlling the oil gating system comprises controlling a pulse width modulated (PWM) valve.

13. The method of claim 9, wherein the at least one cylinder comprises a plurality of cylinders and the controlling the oil gating system comprises controlling a single valve positioned within a common rail of the oil supply system that meters the amount of oil provided to the plurality of cylinders.

14. The method of claim 9, wherein the at least one cylinder comprises a plurality of cylinders and the controlling the oil gating system comprises controlling a plurality of valves positioned within each of the oil supply lines connecting the oil supply system to the plurality of cylinders.

15. The method of claim 9, wherein determining the amount of oil to be delivered comprises using a look up table to determine the amount of oil to be delivered based upon the monitored performance parameters.

16. An internal combustion diesel engine system comprising:

at least one cylinder that receives at least one piston wherein the cylinder defines a combustion region and a cooling region of the diesel engine;

an oil supply system that supplies oil to the cooling region of the at least one cylinder, the system comprising;

one or more sensors that sense performance parameters of the internal combustion engine;

an oil gating system that is controllable so that the amount of oil provided to the cooling region is adjustable;

a controller that receives signals from the one or more sensors and provides control signals to the oil gating system wherein the controller determines the amount of oil to provide to the cooling region based upon the one or more sensors and based upon values in a look up table that are selected to inhibit soot production in both airborne exhaust and in the oil over the operating range of the diesel engine by decreasing the amount of oil provided to the diesel engine so that the oil provided to the cooling region of the cylinder is reduced to inhibit excess soot production.

17. A system for cooling a piston of an internal combustion diesel engine having at least one cylinder that receives the piston wherein the cylinder defines a combustion region and a cooling region, wherein the internal combustion engine includes an oil supply system that supplies oil to the cooling region of the cylinder, the system comprising:

one or more sensors that sense performance parameters of the internal combustion diesel engine;

an oil gating system that is controllable so that the amount of oil provided to the cooling region is adjustable;

a controller that receives signals from the one or more sensors and provides control signals to the oil gating system wherein the controller determines the amount of oil to provide to the cooling region based upon the one or more sensors and based upon values in a look up table that are selected to inhibit soot production in both airborne exhaust and in the oil over the operating range of the engine by decreasing the amount of oil provided to the diesel engine so that the oil provided to the cooling region of the cylinder is reduced to improve the efficiency of the engine.

* * * * *